US010660173B2

(12) United States Patent
Mai et al.

(10) Patent No.: US 10,660,173 B2
(45) Date of Patent: May 19, 2020

(54) SYSTEM AND METHOD USING SWITCH TO REALIZE LIGHT FIXTURE DIMMING AND STATE RESTORATION

(71) Applicant: SHENZHEN SENDIS SEMICONDUCTOR CO., LTD, Shenzhen, Guangdong (CN)

(72) Inventors: Yanquan Mai, Guangdong (CN); Xunsheng Deng, Guangdong (CN); Bo Chen, Guangdong (CN); Xiaoyu Chen, Guangdong (CN)

(73) Assignee: SHENZHEN SENDIS SEMICONDUCTOR CO., LTD, Shenzhen Guangdong (CN)

( * ) Notice: Subject to any disclaimer, the term of this patent is extended or adjusted under 35 U.S.C. 154(b) by 0 days.

(21) Appl. No.: 16/616,366

(22) PCT Filed: May 9, 2018

(86) PCT No.: PCT/CN2018/086103
§ 371 (c)(1),
(2) Date: Nov. 22, 2019

(87) PCT Pub. No.: WO2018/214728
PCT Pub. Date: Nov. 29, 2018

(65) Prior Publication Data

US 2020/0084849 A1 Mar. 12, 2020

(30) Foreign Application Priority Data

May 23, 2017 (CN) ..... 2017 1 0368539

(51) Int. Cl.
*H05B 45/00* (2020.01)
*H05B 45/10* (2020.01)
(Continued)

(52) U.S. Cl.
CPC ..... *H05B 45/10* (2020.01); *H05B 45/37* (2020.01); *H05B 47/16* (2020.01)

(58) Field of Classification Search
CPC ..... H05B 45/00; H05B 45/10; H05B 45/20; H05B 45/30; H05B 45/37; H05B 47/00; H05B 47/10; H05B 47/16
See application file for complete search history.

(56) References Cited

U.S. PATENT DOCUMENTS

2013/0170263 A1 7/2013 Newman, Jr. et al.
2013/0241424 A1* 9/2013 Liao ..... H05B 45/382 315/200 R

FOREIGN PATENT DOCUMENTS

CN 201884990 U 6/2011
CN 104853476 A 8/2015
(Continued)

*Primary Examiner* — Jimmy T Vu
(74) *Attorney, Agent, or Firm* — Muncy, Geissler, Olds & Lowe, PC

(57) ABSTRACT

A system and method using a switch to realize light fixture dimming and state restoration. The system comprises a switch, a line voltage sampling module, a switching action judging module and a dimming control module. The switch connects to at least one light fixture. The line voltage sampling module samples a rectified line voltage output and outputs a corresponding voltage level signal. The switching action judging module identifies and determines a current switching action and outputs a corresponding control instruction to the dimming control module. The dimming control module regulates the lighting state of each light fixture or controls each light fixture to return to its initial lighting state. By identifying and judging switching actions to realize light fixture dimming and state restoration control, the invention can realize a regular dimming function, and can quickly restore the light to a preset initial lighting state.

10 Claims, 6 Drawing Sheets

(51) Int. Cl.
*H05B 45/37* (2020.01)
*H05B 47/16* (2020.01)

(56) References Cited

FOREIGN PATENT DOCUMENTS

| | | | |
|---|---|---|---|
| CN | 105934040 | A | 9/2016 |
| CN | 107182156 | A | 9/2017 |

* cited by examiner

SYSTEM AND METHOD USING SWITCH TO REALIZE LIGHT FIXTURE DIMMING AND STATE RESTORATION

CROSS-REFERENCES TO RELATED APPLICATIONS

This application is a national stage application of PCT Patent Application No. PCT/CN2018/086103, filed on Sep. 5, 2018, which claims priority to Chinese Patent Application No. 201710368539.6, filed on 23 May 2017, the content of all of which is incorporated herein by reference.

FIELD OF THE DISCLOSURE

The invention relates to the technical field of illumination, in particular to a method and a system for realizing lamp dimming and state reset through a switch.

BACKGROUND

The commercially available switch dimming lamps are generally divided into two types. One type has no memory function, and the lighting state needs to be readjusted every time the switch dimming lamps are used while the other type with a memory function needs to be installed thereon an independent switch for each. When a plurality of switch dimming lamps with the memory function are controlled by the same switch, due to dimming asynchrony caused by detection difference or interference of each lamp, the lamps need to be dismantled to erase and write the memory again in order to restore synchronization. Meanwhile, as for the switch dimming lamps with the memory function, if dimming fails to be suitable for a lighting state (brightness or color temperature); all dimming states need to be cycled once to be restored to the initial lighting state. The process is complicated to operate, precious time of a user is wasted, and great inconvenience is brought to the user.

Accordingly, the prior art has yet to be improved.

BRIEF SUMMARY OF THE DISCLOSURE

In view of the defects of the prior art, the disclosure aims at providing a system and a method for realizing lamp dimming and state reset through a switch, realizing dimming and state reset control of a plurality of lamps through judging and identifying the present switch action, enabling all the lamps to quickly restore a preset initial lighting state when a plurality of lamps are out of synchronization in dimming or a proper state is missed in dimming, and enabling the adjusting process to be simple and efficient. The dimming time of the user is greatly shortened.

In order to achieve the purpose, the disclosure adopts the following technical scheme:

A system for realizing lamp dimming and state reset through a switch, which comprises a switch, a line voltage sampling module, a switch action judging module and a dimming control module, the switch is connected with at least one lamp; a line voltage output through rectification is sampled by the line voltage sampling module, and a corresponding level signal is output according to a value of the sampled voltage; a present switch action is judged and recognized by the switch action judging module according to the level signal and a duration time of the level signal, and a corresponding control instruction is output to the dimming control module according to the present switch action; and a lighting state of each lamp is adjusted or each lamp is controlled to restore an initial lighting state by the dimming control module according to the control instruction.

According to the system for realizing lamp dimming and state reset through the switch, the control instruction comprises a restoration instruction and a dimming instruction, when the switch action judging module outputs the restoration instruction, the dimming control module controls each lamp to restore the initial lighting state; when the switch action judging module outputs a dimming instruction, the dimming control module adjusts the lighting state of each lamp.

According to the system for realizing lamp dimming and state reset through the switch, the line voltage sampling module is specifically used for outputting a first level when the sampling voltage is greater than a threshold voltage and outputting a second level when the sampling voltage is less than or equal to the threshold voltage.

According to the system for realizing lamp dimming and state reset through the switch, the switch action judging module comprises:

a first timer used for being cleared to zero and starting timing when the level signal being converted from the first level to the second level, and stopping timing and continuously outputting a first timing value when the level signal being converted from the second level to the first level;

a judging unit used for judging whether the present switch being on or off according to the first timing value;

a second timer used for being cleared to zero and starting timing when the level signal being converted from the second level to the first level for the first time after the switch being off once, and stopping timing and outputting a second timing value when the switch being off again;

the judging unit is also used for judging and identifying the present switch action according to the first timing value and the second timing value, and outputting the corresponding control instruction to the dimming control module according to the present switch action.

According to the system for realizing lamp dimming and state reset through the switch, the judging unit comprises:

a judging subunit used for judging whether the present switch action being a valid instruction action or not according to the first timing value and the second timing value;

an identifying subunit used for identifying the control instruction corresponding to the switch action when the present switch action being the valid instruction action and outputting the control instruction to the dimming control module.

According to the system for realizing lamp dimming and state reset through the switch, the judging subunit is specifically used for:

judging that the switch action to be valid instruction action when the first timing value being greater than a first time threshold and less than a second time threshold, otherwise, judging that the switch action to be invalid instruction action.

According to the system for realizing lamp dimming and state reset through the switch, the identifying subunit is specifically used for:

identifying the control instruction corresponding to the present switch action according to the second timing value when the first timing value being greater than the first time threshold and less than the second time threshold, identifying the control instruction corresponding to the present switch action as a dimming instruction when the second timing value being greater than a third time threshold, and identifying the control instruction corresponding to the present switch action as a restoration instruction when the second timing value being less than or equal to the third time threshold.

According to the system for realizing lamp dimming and state reset through the switch, the judging subunit is further used for:

judging that there being no switch action at the moment when the first timing value being less than or equal to the first time threshold, and controlling the second timer to continue timing; and when the first timing value being greater than or equal to the second time threshold, judging that the switch action being a long switch-off, controlling the system to be reset and the second timer to be cleared to zero, and the second timer starts timing when the level signal being converted from the second level to the first level.

According to the system for realizing lamp dimming and state reset through the switch further comprises an energy storage and power supply module for supplying power to the line voltage sampling module, the switch action judging module and the dimming control module when the switch being on or the switch being off within a preset time.

A method for realizing lamp dimming and state reset through a switch, which comprises the following steps of:

A. sampling a line voltage output through rectification by a line voltage sampling module, and outputting a corresponding level signal according to a value of the sampled voltage;

B. judging and recognizing a present switch action by a switch action judging module according to the level signal and a duration time of the level signal, and outputting a corresponding control instruction to a dimming control module according to the present switch action; and C. adjusting a lighting state of each lamp or controlling each lamp to restore an initial lighting state by the dimming control module according to the control instruction.

Compared with the prior art, according to the system and the method for realizing lamp dimming and state reset through the switch provided by the disclosure, the system comprises a switch, a line voltage sampling module, a switch action judging module and a dimming control module, the switch is connected with at least one lamp, the line voltage output through rectification is sampled by the line voltage sampling module, and a corresponding level signal is output according to the value of the sampled voltage; the present switch action is judged and recognized by the switch action judging module according to the level signal and the duration time of the level signal, and a corresponding control instruction is output to the dimming control module according to the present switch action; and the lighting state of each lamp is adjusted or each lamp is controlled to restore the initial lighting state by the dimming control module according to the control instruction. The dimming and state reset control of the plurality of lamps is realized by judging and identifying the present switch action, when the dimming of the plurality of lamps is out of synchronization in dimming or a proper state is missed, all the lamps can be quickly restored to the preset initial lighting state, the adjusting process is simple and efficient, and the dimming time of a user is greatly shortened.

DETAILED DESCRIPTION OF EMBODIMENTS

In view of the defects that a switch dimming lamp with a memory function cannot quickly return to an initial state and the like in the prior art, the disclosure aims at providing a system and a method for realizing lamp dimming and state reset through a switch, realizing dimming and state reset control of a plurality of lamps through judging and identifying the present switch action, enabling all the lamps to quickly restore a preset initial lighting state when a plurality of lamps are out of synchronization in dimming or a proper state is missed in dimming, and enabling the adjusting process to be simple and efficient. The dimming time of the user is greatly shortened.

To further clarify and clarify the objects, technical solutions and effects of the present disclosure, reference is made to the accompanying drawings which illustrate, by way of example, the present disclosure. It should be understood that the specific embodiments described herein are merely illustrative of the disclosure and are not intended to be limiting thereof.

Figure 1:
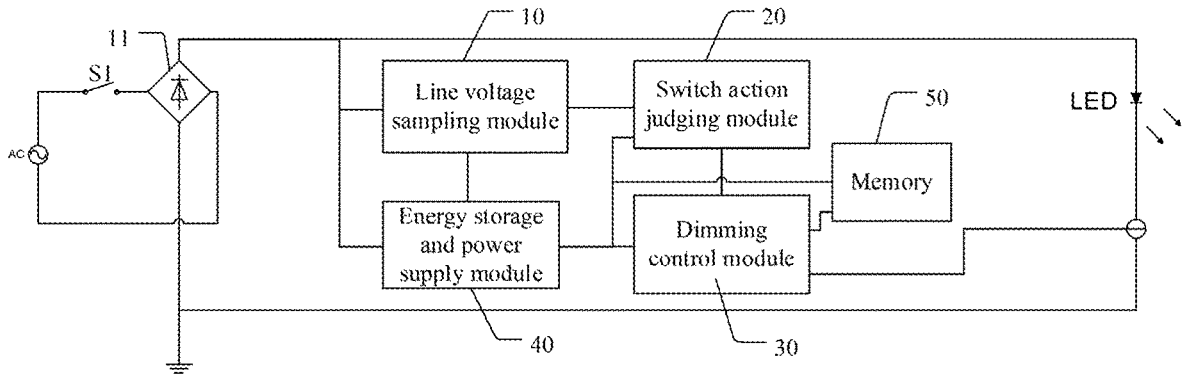
FIG. 1 is a block diagram of a system for realizing lamp dimming and state reset through a switch according to the present disclosure.

Referring to FIG. 1, the system for realizing lamp dimming and state reset through a switch provided by the disclosure comprises a switch S1, a rectifying module 11, a line voltage sampling module 10, a switch action judging module 20, a dimming control module 30 and a memory 50, wherein the switch S1 is connected with at least one lamp (an LED example is shown) to control the on-off state of each lamp; the output end of the rectification module 11 is connected with the line voltage sampling module 10 and the LED lamp, the line voltage sampling module 10 is also connected with the switch action judging module 20, and the dimming control module 30 is connected with the switch action judging module 20, the memory 50 and the LED lamp.

The rectification module 11 is used for rectifying alternating current, the line voltage sampling module 10 is used for sampling the line voltage output through rectification and outputting a corresponding level signal according to the value of the sampled voltage; the switch action judging module 20 is used for judging and identifying the present switch action according to the level signal and the duration time thereof, and outputting a corresponding control instruction to the dimming control module 30 according to the present switch action; the dimming control module 30 is used for adjusting the lighting state of each lamp or controlling each lamp to restore the initial lighting state according to the control instruction, and the memory 50 is used for storing the dimming value of the lamp. In this embodiment, the rectifier module 11 is a rectifier bridge and the dimming control module 30 is a dimming control state machine.

According to the disclosure, the line voltage output through rectification is sampled by the line voltage sampling module 10, a corresponding level signal is output according to the value of the sampled voltage so as to subsequently judge the on or off state of the switch, and then the present switch action is judged and recognized by the switch action judging module 20 according to the level signal and the duration time thereof, such as long switch-off, short switch-off or shaking when touching the switch and the like. A corresponding control instruction is output to the dimming control module 30 according to the present switch action. Specifically, the control instruction at least comprises a restoration instruction and a dimming instruction, when the dimming instruction is output by the switch action judging module 20, the lighting state of each lamp, for example, the brightness and color temperature of each lamp is adjusted by the dimming control module 30. When the restoration instruction is output by the switch action judging module 20, each lamp is controlled by the dimming control module 30 to restore the initial lighting state, so that all lamps achieve synchronization of the lighting states. After the adjustment, the dimming values of the respective lamps are written into the memory 50, so that the dimming values can be directly invoked after the next power supply, and the memory function of the lamps is realized. In particular, the lighting states such as brightness, color temperature and the like can be adjusted by the dimming control module 30 through adjusting the current or voltage of the lamp.

According to the disclosure, the dimming and state reset control of the plurality of lamps are realized by judging the recognized switch action, the dimming control of the plurality of lamps can be realized by only one switch, and if the dimming of each lamp is not synchronous with the dimming caused by detection difference or interference, the lamps do not need to be dismantled to erase the memory again, and all the lamps can be controlled to restore the initial lighting state only by outputting corresponding control instructions through the switch action. The fast restoration synchronization function is realized.

Figure 2:
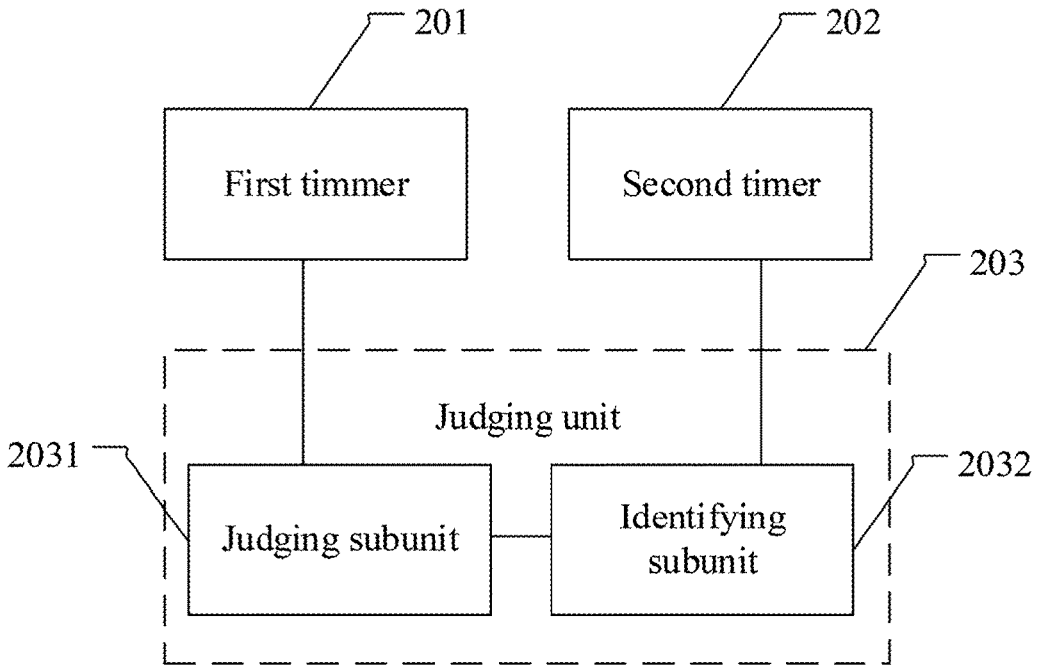
FIG. 2 is a block diagram of a switch action judging module in a system for realizing lamp dimming and state reset through a switch according to the present disclosure.
Figure 3:
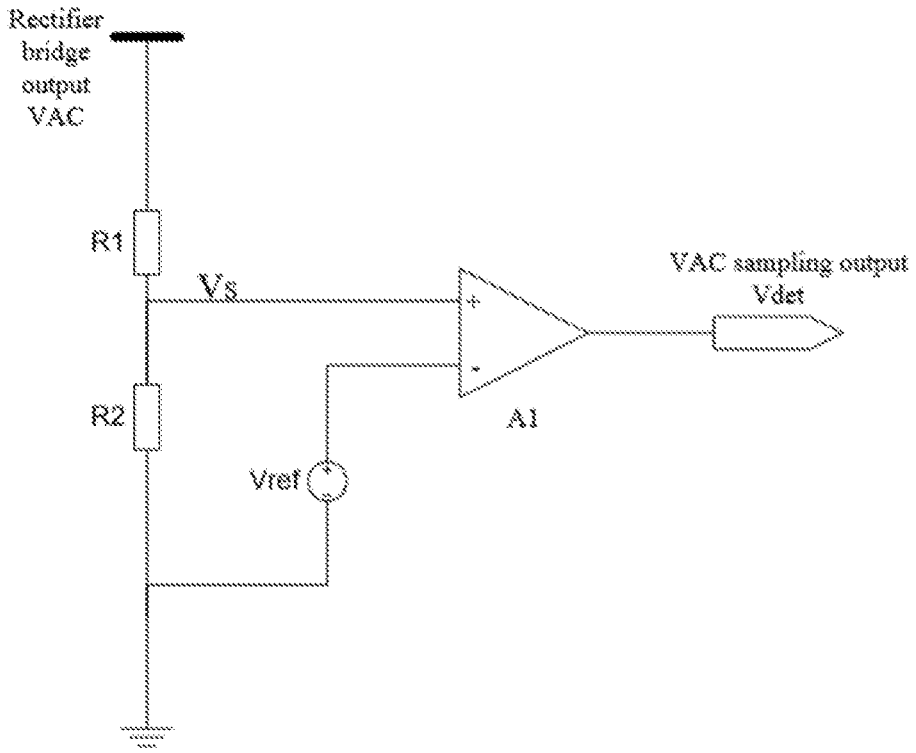
FIG. 3 is a circuit diagram of a line voltage sampling module in a system for realizing lamp dimming and state reset through a switch according to the present disclosure.

With further reference to FIGS. 2 and 3, the line voltage sampling module 10 is specifically configured to output a first level when the sampling voltage is greater than the threshold voltage and a second level when the sampling voltage is less than or equal to the threshold voltage. In this embodiment, the line voltage sampling module 10 is implemented using a sampling comparison circuit as shown in FIG. 3 and includes a first resistor R1, a second resistor R2, a reference voltage source Vref, and a comparator A1. One end of the first resistor R1 is connected with the output end of the rectifier bridge, the other end of the first resistor R1 is connected with the in-phase input end of the comparator A1, and is grounded through a second resistor R2; the positive pole of the reference voltage source Vref is connected with the anti-phase input end of the comparator A1, the negative pole of the reference voltage source Vref is grounded, and a level signal Vdet is output from the output end of the comparator A1 to the switch action judging module 20. The rectifier bridge output VAC voltage is divided by a first resistor R1 and a second resistor R2 to obtain a sampling voltage Vs, and then compared with a reference voltage Vref. When the sampling voltage Vs is greater than the reference voltage Vref, a Vdet high level is output, otherwise, a Vdet low level is output, i.e. in the present embodiment, the first level is a high level and the second level is a low level. In other embodiments, the first level may also be used as a low level and the second level as a high level, to which the present disclosure is not limited, as it can be specifically set according to practical requirements. The rectified output line voltage is converted into a high-low level signal by the line voltage sampling module 10, and since the line voltage is related to the close/off state of the switch, the current switch state can be further obtained according to the high-low level signal output by the line voltage sampling module 10 for subsequent judgment on the switch action.

Specifically, the switch action judging module 20 includes a first timer 201, a second timer 202, and a judging unit 203, and the first timer 201 and the second timer 202 are connected to the judging unit 203. The first timer 201 is used for being cleared to zero and starting timing when the level signal is converted from a first level to a second level, and stopping timing and continuously outputting a first timing value when the level signal is converted from the second level to the first level, i.e. the first timer 201 is used for timing when the switch is in an off state; the judging unit is used for judging whether the current switch is off or not according to the first timing value; the second timer 202 is used for being cleared to zero and starting timing when the level signal is converted from the second level to the first level for the first time after one switch is off, and stopping timing and outputting a second timing value when the switch is off again, i.e. the clearing to be zero, starting timing and stopping timing of the second timer 202 are related to a first timing value judging result output by the first timer. When it is judged that the second level is converted to the first level for the first time after the switch is off, i.e., at this time, the switch is from an off state to an on state, the second timer 202 starts timing, and when it is judged again that the switch performs an off action according to the first timing value, indicating that the switch is from an on state to an off state, the second timer 202 stops timing and outputs a timing result, thereby timing when the switch is in the on state through the second timer 202; the judging unit 203 is also used for judging and identifying the present switch action according to the first timing value and the second timing value, and outputting a corresponding control instruction to the dimming control module 30 according to the present switch action.

According to the disclosure, the state of the level signal is detected and timed, the present switch action and the duration time of the present switch action are judged and recognized according to the level state and the corresponding timing value, and then a corresponding control instruction is output, so that the dimming control module 30 controls the voltage or the current of the lamp according to the corresponding control instruction to realize the regulation of the lighting state. A user only needs to carry out simple operation on the lamp switch to achieve the effect of simultaneously dimming or quickly restoring synchronization, the dimming efficiency is improved, and the time is effectively saved.

Further, the judging unit 203 comprises a judging subunit 2031 and a recognition subunit 2032, wherein the judging subunit 2031 is connected with the recognition subunit 2032 and the first timer 201. The recognition subunit 2032 is also connected with the second timer 202, and the judging subunit 2031 is used for judging whether the present switch action is a valid instruction action or not according to the first timing value and the second timing value; the recognition subunit 2032 is used for recognizing a control instruction corresponding to the switch action when the present switch action is a valid instruction action and outputting the control instruction to the dimming control module 30.

Since the user may have a plurality of switch actions when operating the switch, the invalid switch actions are filtered out by the judgment subunit 2031, thereby avoiding instruction processing confusion. In particular, when the first timing value is greater than the first time threshold value and less than the second time threshold value, the judging subunit 2031 is specifically used for judging that as a valid instruction action, otherwise, as an invalid instruction action. Short switch-off is defined as a valid action. i.e., the first timing value is greater than the first time threshold value but less than the second time threshold value, that is to say, the switch off time is within a preset interval, a user switches off quickly and then switches on again, at the moment, the switch is defined as a short switch-off action. When the switch performs the short switch-off operation, the control instruction corresponding to the present switch action is continuously identified as a restoration instruction or a dimming instruction, and when the switch does not perform the short switch-off operation, instruction identification is not carried out, so that system power consumption is saved.

Therefore, when the first timing value is less than or equal to the first time threshold value, the judging subunit 2031 is also used for judging that no switch action exists at the moment, and controlling the second timer 202 to continue timing; and when the first timing value is greater than or equal to the second time threshold value, judging to be a long switch-off at the moment, resetting the control system, controlling the second timer 202 to be cleared to zero, and starting timing when the level signal is converted from the second level to the first level. When the first timing value is less than or equal to the first time threshold value, jitter caused by mistake of touching the switch at the moment can be caused, so that short second level time occurs, no switch action is judged at the moment, the second timer 202 is controlled to continue timing, and misoperation is effectively filtered. However, when the first timing value is greater than or equal to the second time threshold value, the user switches off for a long time, which is conventional operation of switching on after the switch being off without the intention of outputting a restoration instruction or a dimming instruction, so that each module in the control system is reset, the system is powered on again, the second timer 202 is cleared to zero, and timing is restarted when the level signal is converted from the second level to the first level, that is, the time the switch being on is timed when switching on after a long switch-off. Various switch operation conditions are distinguished according to different switch-off times, invalid instruction actions and conventional switch-off actions in actual operation are effectively avoided, and accuracy and intelligence of system dimming and state reset are improved.

Further, when the user performs a short switch-off operation, i.e. when the first timing value is greater than the first time threshold but less than the second time threshold, it is a valid instruction action, and then the recognition subunit 2032 continues to recognize a specific instruction corresponding to the switch action, so that when the first timing value is greater than the first time threshold but less than the second time threshold, the recognition subunit 2032 is specifically used for identifying a control instruction corresponding to the present switch action according to the second timing value, when the second timing value is greater than a third time threshold, identifying it as a dimming instruction, and when the second timing value is less than or equal to the third time threshold, identifying it as a restoration instruction.

When it is judged that the user performs short switch-off, it is judged to be a valid instruction action, the user needs to dim the lamp or restore the initial state at the moment, so that the second timing value, i.e., the time for which the switch is off, is continuously judged and recognized through the recognition subunit 2032; when the second timing value is greater than the third time threshold, which means the switch is kept on for a period after being off and no more switching off action, it is judged as a dimming instruction, for example, the brightness or color temperature of the lamp is adjusted to the next dimming value, a corresponding sequence of dimming values is stored in the memory 50 in advance, and the pre-stored dimming values in the memory 50 are invoked in sequence every time a dimming instruction is received, so that the lighting state is adjusted. However, when the second timing value is less than the third time threshold value, it is explained that the user switches on again for a short time after the first short switch-off, and then performs the switch-off operation for the second time, which is judged as a restoration instruction at this time. It should be clear that since the first timer 201 restarts timing to obtain a new first timing value when switching off for the second time, the second switch-off is also short switch-off to ensure that the switch action is not judged as an invalid instruction action. i.e., when the duration time of the second switch-off is longer than the first time threshold value but shorter than the second time threshold value, and the user closes the switch again, all lamps are restored to the initial lighting state, i.e., when the user performs double-click operation on the switch, the lamps are restored to the preset initial lighting state quickly after rapid off-on-off-on operation. In particular, the initial dimming value prestored in the memory 50 is invoked by the dimming control module 30, and synchronous restoration of the lamp lighting state is realized. Meanwhile, when operation errors occur, the system can quickly return to an initial state to be readjusted, all states do not need to be cycled once, and the time for adjustment is saved.

Figure 4:
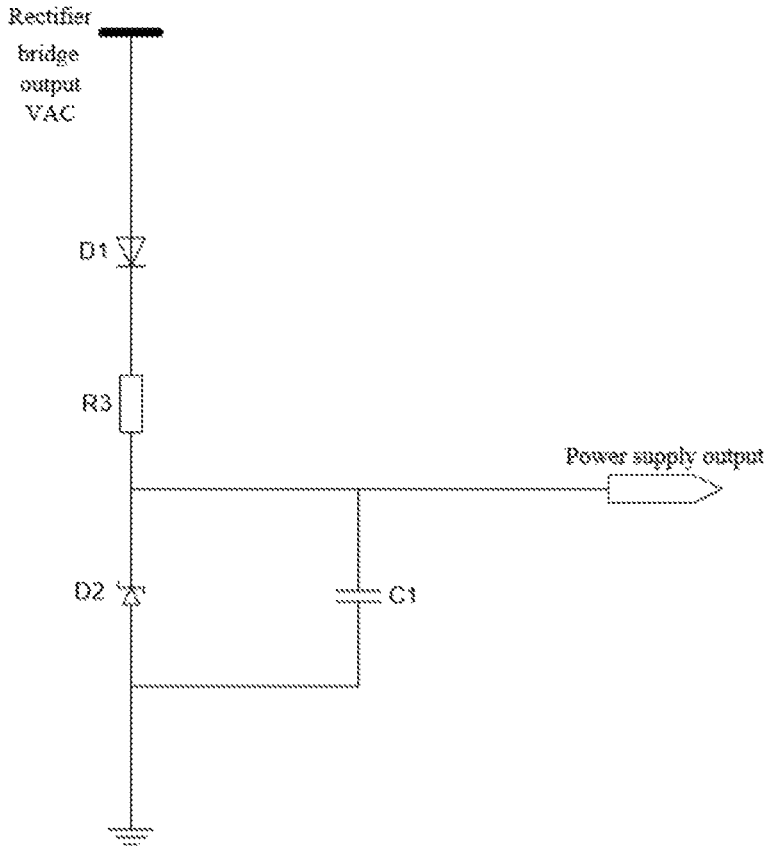
FIG. 4 is a circuit diagram of an energy storage and power supply module in a system for realizing lamp dimming and state reset through a switch according to the present disclosure.
Figure 5:
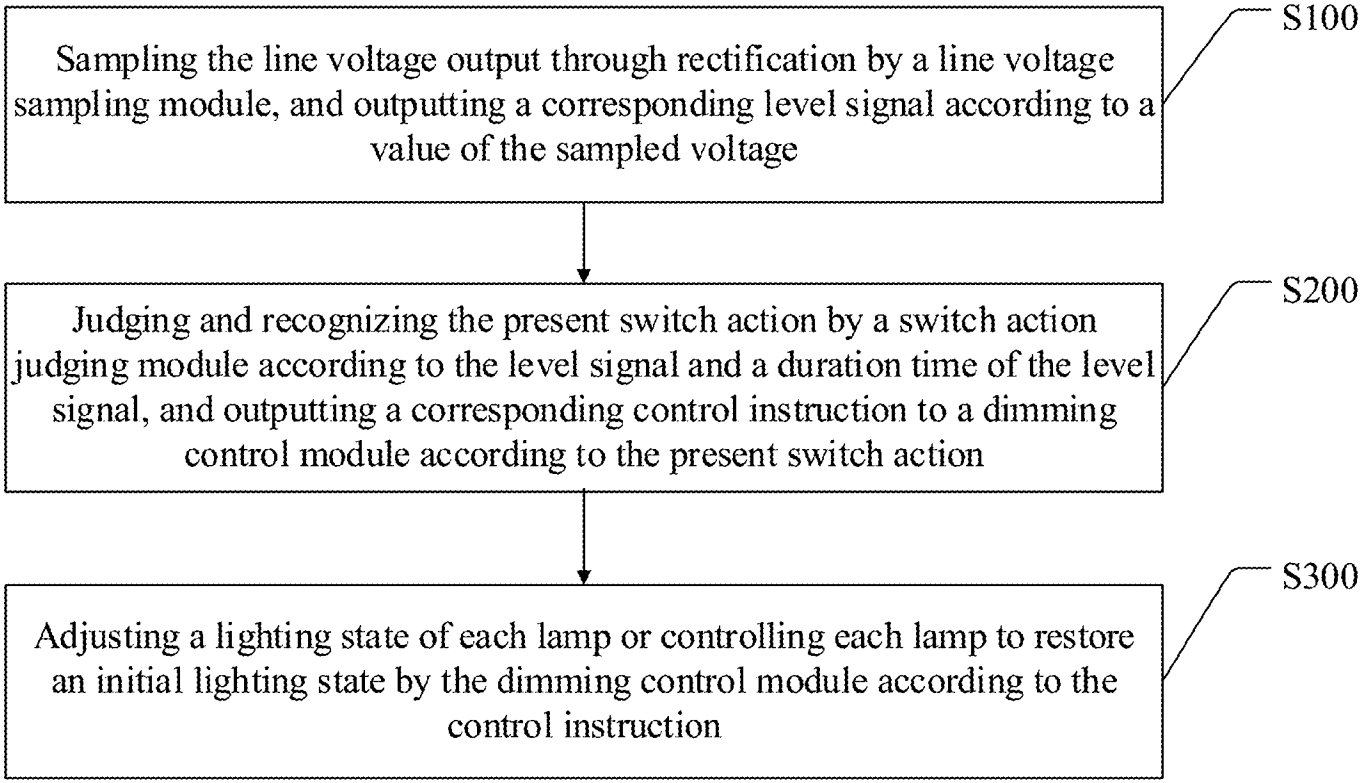
FIG. 5 is a flow chart of a method for dimming a lamp and resetting a state through a switch in accordance with the present disclosure.

Preferably, referring to FIG. 4 together, the system for realizing lamp dimming and state reset through a switch according to the present disclosure further comprises an energy storage and power supply module 40, wherein the energy storage and power supply module 40 is connected with the output end of the rectifying module 11, the line voltage sampling module 10, the switch action judging module 20, the dimming control module 30 and the memory 50. The energy storage and power supply module 40 is used for supplying power to the line voltage sampling module, the switch action judging module 20, the dimming control module 30 and the memory 50 when the switch is on or is off within a preset time, that is, when the switch is on, the energy storage and power supply module 40 supplies power to other modules, and when the switch is off, the energy storage and power supply module 40 can continue to maintain the power supply of each module within a preset time, so as to ensure that each module can normally work when a user performs rapid dimming or synchronous restoration, and when the switch is off for a time longer than the preset time, the energy storage and power supply module 40 cannot continue to supply power, each module is reset, and the system is powered on again when the switch is on again.

In the embodiment, the energy storage and power supply module 40 is implemented by adopting an energy storage and power supply circuit as shown in FIG. 4 and comprises a first diode D1, a second diode D2, a third resistor R3 and a capacitor C1, wherein the anode of the first diode D1 is connected with the output end of the rectifier bridge, the cathode of the first diode D1 is connected with the cathode of the second diode D2 and one end of the capacitor C1 through the third resistor R3; and the other end of the second diode D2 and the other end of the capacitor C1 are both grounded, and the other end of the third resistor R3 serves as an output end of the energy storage and power supply module 40 to output and supply power for other modules.

Based on the system for realizing lamp dimming and state reset through the switch, the disclosure also correspondingly provides a method for realizing lamp dimming and state reset through the switch, and the method comprises the following steps of:

S100, sampling the line voltage output through rectification by a line voltage sampling module, and outputting a corresponding level signal according to the value of the sampled voltage;

S200, judging and recognizing the present switch action by the switch action judging module according to the level signal and the duration time of the level signal, and outputting a corresponding control instruction to the dimming control module according to the present switch action; and S300, adjusting the lighting state of each lamp by the dimming control module or controlling each lamp to restore the initial lighting state according to the control instruction.

Since the above-described system for realizing lamp dimming and state resetting through a switch has been described in detail, specific reference is made to the corresponding embodiments of the above-described system, which will not be described in detail herein.

In order to better understand the working process of the system for realizing lamp dimming and state reset through a switch provided by the disclosure, the dimming and state restoration process of the disclosure is described in detail with reference to specific application embodiments in conjunction with FIGS. 1-7.

Figure 6:
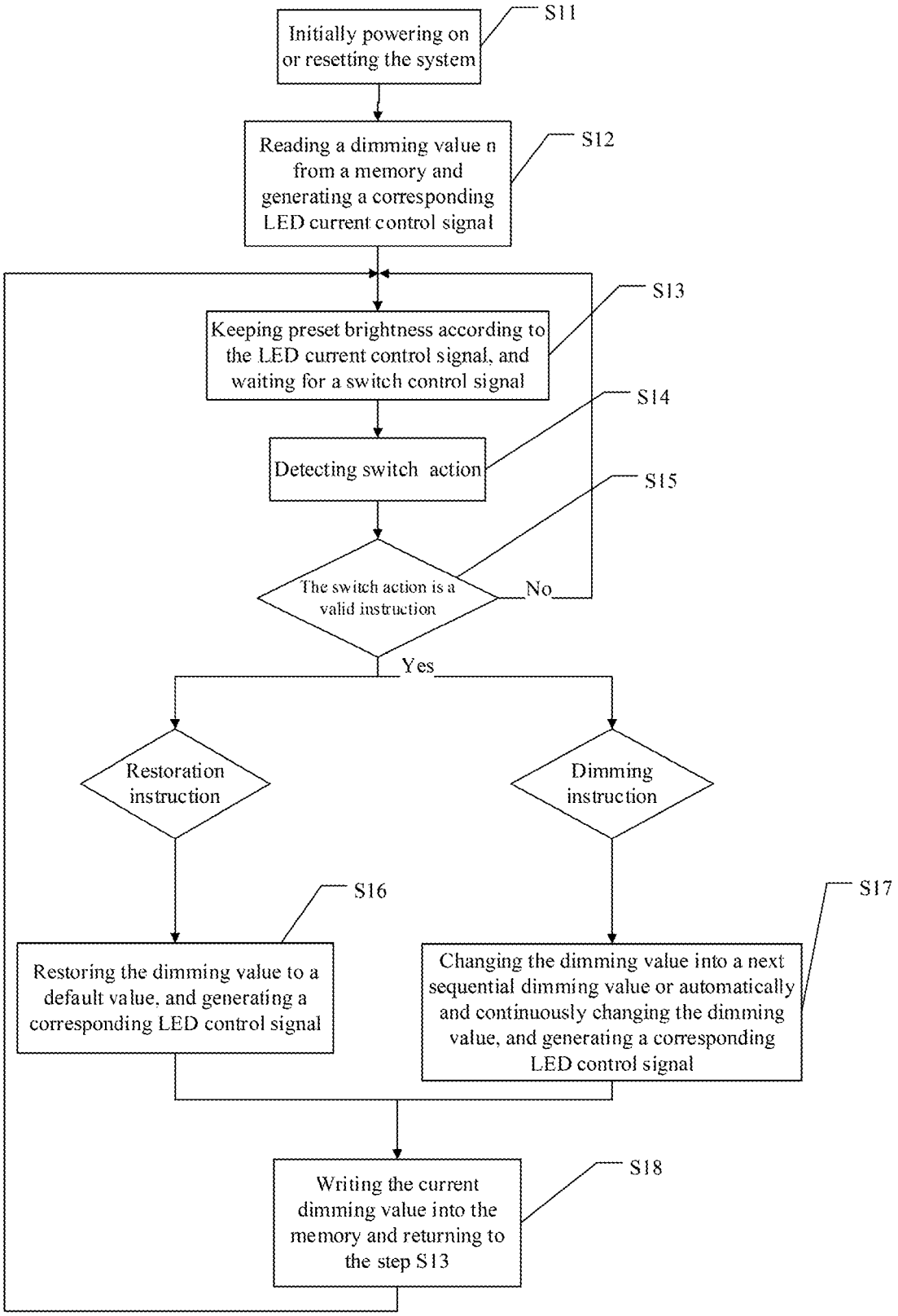
FIG. 6 is a flowchart of a method of a first application embodiment provided by the present disclosure.

As shown in FIG. 6, the dimming and state restoration process comprises the following steps:

S11, initially powering on or resetting the system;

S12, reading a dimming value n from a memory and generating a corresponding LED current control signal;

S13, keeping preset brightness according to the LED current control signal, and waiting for a switch control signal;

S14, detecting switch action;

S15, judging whether the switch action is a valid instruction, if so, executing the step S16 when the switch action is a restoration instruction, and executing the step S17 when the switch action is a dimming instruction; if not, returning to step S13;

S16, restoring the dimming value to a default value, and generating a corresponding LED control signal;

S17, changing the dimming value into the next sequential dimming value or automatically and continuously changing the dimming value, and generating a corresponding LED control signal;

S18, writing the current dimming value into the memory and returning to the step S13.

When a switch is on again after the system is initially powered on or reset, for example, after being off for a long time and the system is powered on again, a dimming value n stored when the system is off for the last time is read from a memory, and a corresponding LED control signal is generated. The lighting state of the lamp is controlled according to the LED control signal, the lamp is restored to the state when the system is off for the last time, the memory function of the lamp is realized. Then when the switch action is detected, whether the switch action is a valid instruction or not is judged, if so, identification is continued, and if not, a switch control signal is waited to be received. If the current instruction is a restoration instruction, a dimming value is restored to a preset default value and a corresponding LED control signal is generated to control all lamps to be restored to an initial lighting state. If the current instruction is a dimming instruction, the dimming value is changed to a next sequential dimming value according to the sequence of the dimming values in the memory; or the dimming values are automatically and continuously changed to realize stepless dimming, corresponding LED control signals are generated to control all lamps to perform dimming operation.

Figure 7:
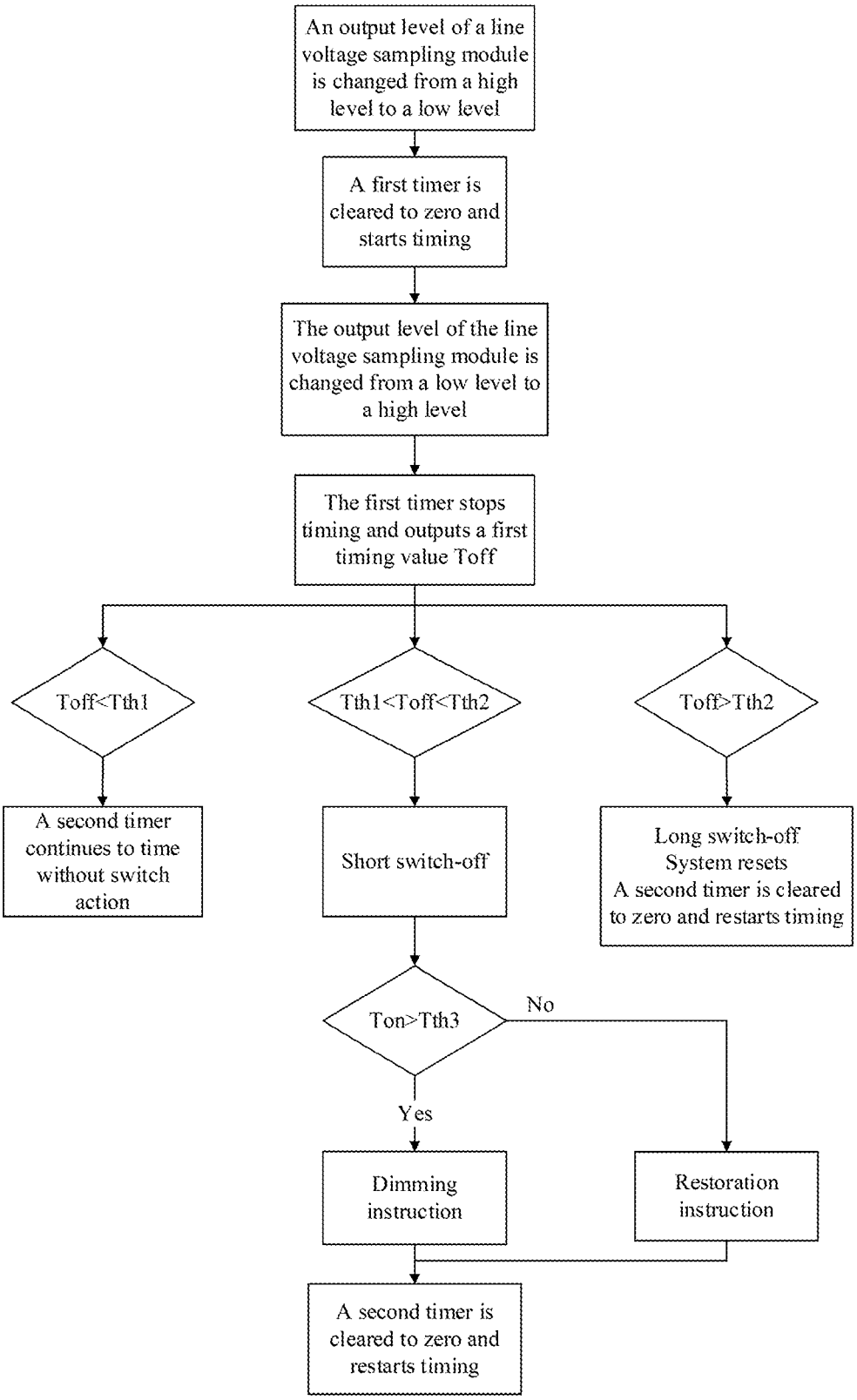
FIG. 7 is a flowchart of a method of a second application embodiment provided by the present disclosure.

Specifically, as shown in FIG. 7, judged through the switch action, the current control instruction specifically comprises: when the output level of the line voltage sampling module is converted from a high level to a low level, the first timer is cleared to zero and starts timing, when the output level of the line voltage sampling module is converted from a low level to a high level, the first timer stops timing and outputs a first timing value Toff. If the first timing value Toff is less than (less than or equal to) a first time threshold value Tth1, it is judged that the switch is kept on without action, and the second timer keeps timing; if the first timing value Toff is greater than or equal to (greater than) Tth1 and less than (less than or equal to) a second time threshold value Tth2, it is judged to be a short switch off, and at the moment, if the second timing value Ton of the second timer is less than (less than or equal to) a third time threshold value Tth3, it is judged to be a synchronization instruction; if Ton is greater than or equal to (greater than) the third time threshold Tth3, it is judged as a dimming instruction, and then the second timer is cleared to zero and restarts timing; if the first timing value Toff is greater than or equal to (greater than) Tth2, it is judged to be a long switch off, each module is reset, and the second timer is cleared to zero and restarts timing.

Taking specific data as an example, assuming that the mains supply power is 220V, 50 Hz alternating current, Vref=1V, R1:R2=95:1, then a level signal Vdet output by the line voltage sampling module is a square wave with a period of 10 ms, a first level time Thi=8 ms, and a second level time Tlo=2 ms. Tth1>Tlo must be satisfied, and Tth1=60 ms is taken, which not only meets the requirements, but also can filter the jitter away when touching the switch.

Assuming that the regulated voltage value of the second diode is 6 v, C1=10 uf, the lowest working voltage of the system is 3 v, and the working current is 10 uA, the energy storage and power supply module can maintain a system power supply time Thold=3 s after the switch is off, and Tth2<Thold must be satisfied, Tth2=2 s is taken. The human reaction time is approximately 200 ms, and Tth3=600 ms is taken.

Assuming that the initial states of the two lamps controlled by the same switch are identical, the production difference of the lamp 1 is +5% and the production difference of the lamp 2 is −5%, resulting in Tth11=63 ms, Tth21=2.1 s, Tth31=630 ms for the lamp 1, and Tth12=57 ms, Tth22=1.9 s, Tth32=570 ms for the lamp 2. At the moment, a switch needs to be triggered to adjust the brightness, the switch is on after being off for 2 s, the lamp 1 successfully switches the brightness state and writes the new state into the nonvolatile memory; the lamp 2 is powered on again, the last saved state is read from the nonvolatile memory, and the states of the two lamps are out of synchronization. At this time, the switch is quickly subjected to two off-on-off-on operations. Generally, the time for continuous operation by human hands is approximately between 100 ms and 300 ms, and the operation time is assumed to be off for 300 ms, on for 400 ms, off for 300 ms and on for a long-term. After the switch is on at the last time, the output of the line voltage sampling module is converted from a low level to a high level, and Toff=300 ms, Ton=400 ms satisfies Tth11<Toff<Tth21, Ton<Tth31, simultaneously satisfies Tth12<Toff<Tth22, Ton<Tth32. The two lamps are judged to receive synchronous instructions at the same time, the brightness states are switched to the default brightness at the same time, and the default value is written into the nonvolatile memory, so that the fast state reset of the multiple lamps is realized.

In summary, according to the system and the method for realizing lamp dimming and state reset through a switch, the system comprises a switch, a line voltage sampling module, a switch action judging module and a dimming control module, wherein the switch is connected with at least one lamp, the line voltage output through rectification is sampled by the line voltage sampling module, and a corresponding level signal is output according to the value of the sampled voltage; the present switch action is judged and recognized by the switch action judging module according to the level signal and the duration time thereof, and a corresponding control instruction is output to the dimming control module according to the present switch action; and the lighting state of each lamp is adjusted by the dimming control module according to the control instruction or each lamp is controlled to restore the initial lighting state. The dimming and state reset control of the plurality of lamps is realized by judging and identifying the present switch action, when the dimming of the plurality of lamps is out of synchronization in dimming or a proper state is missed, all the lamps can be quickly restored to the preset initial lighting state, the adjusting process is simple and efficient, and the dimming time of a user is greatly shortened.

It will be understood by those skilled in the art that equivalent alterations and modifications may be made in accordance with the teachings of this invention and its inventive concepts, and all such alterations and modifications are intended to fall within the scope of the appended claims.

What is claimed is:

1. A system for realizing lamp dimming and state reset through a switch, wherein comprising a switch, a line voltage sampling module, a switch action judging module and a dimming control module, the switch is connected with at least one lamp; a line voltage output through rectification is sampled by the line voltage sampling module, and a corresponding level signal is output according to a value of the sampled voltage; a present switch action is judged and recognized by the switch action judging module according to the level signal and a duration time of the level signal, and a corresponding control instruction is output to the dimming control module according to the present switch action; and alighting state of each lamp is adjusted or each lamp is controlled to restore an initial lighting state by the dimming control module according to the control instruction.

2. The system for realizing lamp dimming and state reset through the switch according to claim 1, wherein the control instruction comprises a restoration instruction and a dimming instruction, when the switch action judging module outputs the restoration instruction, the dimming control module controls each lamp to restore the initial lighting state; when the switch action judging module outputs a dimming instruction, the dimming control module adjusts the lighting state of each lamp.

3. The system for realizing lamp dimming and state reset through the switch according to claim 1, wherein the line voltage sampling module is specifically used for outputting a first level when the sampling voltage is greater than a threshold voltage and outputting a second level when the sampling voltage is less than or equal to the threshold voltage.

4. The system for realizing lamp dimming and state reset through the switch according to claim 3, wherein the switch action judging module comprises:

a first timer used for being cleared to zero and starting timing when the level signal being converted from the first level to the second level, and stopping timing and continuously outputting a first timing value when the level signal being converted from the second level to the first level;

a judging unit used for judging whether the present switch being on or off according to the first timing value;

a second timer used for being cleared to zero and starting timing when the level signal being converted from the second level to the first level for the first time after the switch being off, and stopping timing and outputting a second timing value when the switch being off again;

the judging unit is also used for judging and identifying the present switch action according to the first timing value and the second timing value, and outputting the corresponding control instruction to the dimming control module according to the present switch action.

5. The system for realizing lamp dimming and state reset through the switch according to claim 4, wherein the judging unit comprises:

a judging subunit used for judging whether the present switch action being a valid instruction action or not according to the first timing value and the second timing value;

an identifying subunit used for identifying the control instruction corresponding to the switch action when the present switch action being the valid instruction action and outputting the control instruction to the dimming control module.

6. The system for realizing lamp dimming and state reset through the switch according to claim 5, wherein the judging subunit is specifically used for:

judging that the switch action to be valid instruction action when the first timing value being greater than a first time threshold and less than a second time threshold, otherwise, judging that the switch action to be invalid instruction action.

7. The system for realizing lamp dimming and state reset through the switch according to claim 5, wherein the identifying subunit is specifically used for:

identifying the control instruction corresponding to the present switch action according to the second timing value when the first timing value being greater than the first time threshold and less than the second time threshold, identifying the control instruction corresponding to the present switch action as a dimming instruction when the second timing value being greater than a third time threshold, and identifying the control instruction corresponding to the present switch action as a restoration instruction when the second timing value being less than or equal to the third time threshold.

8. The system for realizing lamp dimming and state reset through the switch according to claim 6, wherein the judging subunit is further used for:

judging that there being no switch action at the moment when the first timing value being less than or equal to the first time threshold, and controlling the second timer to continue timing; and when the first timing value being greater than or equal to the second time threshold, judging that the switch action being a long switch-off, controlling the system to be reset and the second timer to be cleared to zero, and the second timer starts timing when the level signal being converted from the second level to the first level.

9. The system for realizing lamp dimming and state reset through the switch according to claim 1, wherein further comprising an energy storage and power supply module for supplying power to the line voltage sampling module, the switch action judging module and the dimming control module when the switch being on or when the switch being off within a preset time.

10. A method for realizing lamp dimming and state reset through a switch, wherein comprising the following steps of:

A. sampling a line voltage output through rectification by a line voltage sampling module, and outputting a corresponding level signal according to a value of the sampled voltage;

B. judging and recognizing a present switch action by a switch action judging module according to the level signal and a duration time of the level signal, and outputting a corresponding control instruction to a dimming control module according to the present switch action; and C. adjusting alighting state of each lamp or controlling each lamp to restore an initial lighting state by the dimming control module according to the control instruction.

* * * * *